US006186701B1

(12) United States Patent
Kempers

(10) Patent No.: US 6,186,701 B1
(45) **Date of Patent: *Feb. 13, 2001**

(54) ELONGATE FLEXIBLE CONTAINER

(75) Inventor: Anton Daniel Kempers, Ev Almelo (NL)

(73) Assignee: Ten Cate Nicolon B.V., Almelo (NL)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/117,961

(22) PCT Filed: Feb. 10, 1997

(86) PCT No.: PCT/NL97/00043

§ 371 Date: Mar. 16, 1999

§ 102(e) Date: Mar. 16, 1999

(87) PCT Pub. No.: WO97/29246

PCT Pub. Date: Aug. 14, 1997

(30) Foreign Application Priority Data

Feb. 8, 1996 (NL) ..... 1002277

(51) Int. Cl.[7] ..... E02B 3/12

(52) U.S. Cl. ..... 405/19; 383/66; 383/105; 383/107; 383/904; 405/111

(58) Field of Search ..... 405/15, 18, 19, 405/111, 115; 383/66, 105, 107, 117, 58, 904

(56) References Cited

U.S. PATENT DOCUMENTS

| | | | | |
|---|---|---|---|---|
| 1,211,853 | * | 1/1917 | Huggins | 383/66 |
| 4,441,627 | * | 4/1984 | Takeuchi | 383/66 |
| 4,449,847 | * | 5/1984 | Scales et al. | 405/19 |
| 4,690,585 | * | 9/1987 | Holmberg | 405/19 |
| 4,878,446 | * | 11/1989 | Vermeulen | 405/17 |
| 4,889,446 | * | 12/1989 | Holmberg | 405/19 |
| 5,902,070 | * | 5/1999 | Bradley | 405/21 |

FOREIGN PATENT DOCUMENTS

| | | | |
|---|---|---|---|
| 267661 | * | 5/1988 | (EP) . |
| 0267661 | | 5/1988 | (EP) . |
| 8803583 | | 5/1988 | (WO) . |

* cited by examiner

*Primary Examiner*—Stephen P. Garbe
(74) *Attorney, Agent, or Firm*—Webb Ziesenheim Logsdon Orkin & Hanson, P.C.

(57) ABSTRACT

An elongate flexible container, made of a textile fabric and having at least one filling opening. The container is filled with solid material, such as sand or other ground material, for the formation of a body adapted for use as a core or base of a dam, a quay, a bank reinforcement, a jetty or a breakwater, or for filling holes or trenches, or for use at the bed of a waterway, or for the packaging and storage of contaminated material. The container is provided at its upper side with at least one filling opening. The container includes stitching extending in the longitudinal direction of the container and mutually connecting facing edges of the textile fabric.

10 Claims, 3 Drawing Sheets

ELONGATE FLEXIBLE CONTAINER

BACKGROUND OF THE INVENTION

1. Field of the Invention

The present invention relates to an elongate flexible container having a relatively heavy and deformable body which is capable of accommodating itself to the shape of the ground.

2. Description of the Prior Art

An elongate flexible container is disclosed in EP-A-0 267 661.

SUMMARY OF THE INVENTION

The elongate flexible container of the present invention generally includes a textile fabric and defines at least one filling opening for filling the fabric container with loose solid material having little or no coherency, such as sand or other similar material. The container is used for the formation of a core or base of a dam, a quay, a bank reinforcement, a jetty, or a breakwater. The container is also used for filling holes or trenches, for the packaging and storage of contaminated material, or other uses. The container defines at least one filling opening at an upper side thereof, and includes stitching extending in a longitudinal direction along a lower side of the container, with the stitching mutually connecting facing longitudinal edges of the textile fabric.

Because the fabric material of the flexible container has a sufficient tensile strength and wear-resistance, and the container is provided with a filling opening at the upper side thereof and is provided at its lower side with stitching, the container may be filled with solid filling material through the filling opening. The stitching located at the lower side, or the bottom of the container, is gradually covered by the solid filling material and thus gradually covered by a large mass of the filling material. The textile fabric and the stitching at the lower side of the container are located between the solid filling material and the ground. Thus, the textile fabric and the stitching at the lower side of the container are not, or at most to a negligible degree, subjected to tensile forces which would tend to tear open the stitching.

It is noted in passing that in applicant's patent application entitled "flexible container", which was filed on the same day as the present application, discloses a container which defines over its entire surface area a plurality of mutually spaced through-holes covered with gauze. As a result of this configuration, air and water may pass into the container, but solid material is confined within the container. Such covered through-holes may advantageously be used in connection with the elongate flexible container according to the present invention. However, the present invention does not primarily relate to this feature.

The container according to the invention also has a plurality of parts abutting in a longitudinal direction that are mutually connected by stitching that extends transverse to the longitudinal direction. The stitching connects the parts together. The stitching may also be provided in the form of separate swatches stitched to the parts. The stitching extends substantially transverse to the longitudinal direction of the container. It should be understood that the tensile forces acting on the container mainly extend in a tangential direction in the textile fabric (i.e., extending transversely relative to the longitudinal direction of the container). Due to the fact that the stitching extends in the transverse direction they are not, or at most in negligible degree, loaded by tensile forces, which might tear apart the stitching.

A preferred embodiment has the stitching at the lower side of the container extending in the longitudinal direction connecting two tangentially overlapping edges of the fabric.

In order to achieve homogeneous filling of the container, the container includes a plurality of filling openings arranged in a distributed manner over the entire length of the container, e.g., at regular mutual distances of about 25 meters.

Another embodiment has the feature that each filling opening includes a flexible filling tube. The filling tube preferably has a length of 0.5–3.0 meters and a diameter of 0.20–0.70 meters.

A specific embodiment of the present invention has the feature that the textile fabric is water-permeable.

The textile fabric of the container must have a sufficiently high strength in order not to lose its integrity, particularly during the filling operation. Consequently, a preferred embodiment has the feature that the fabric has in both main directions a tensile strength of over 80 kN/m.

A specific embodiment of the present invention has the feature that the textile fabric substantially consists of PP (polypropylene).

An alternative embodiment of the present invention has the feature that the fabric substantially consists of polyester and PE (polyethylene).

Another specific embodiment of the present invention has the feature that the filling tube widens in a downward direction.

Furthermore, the present invention is a method for filling a flexible container of the type described hereinabove, which container includes a filling opening in the form of a flexible tube. The method according to the present invention includes the steps of:

- guiding a supply tube of fixed shape through the flexible tube and into the container;
- temporarily coupling the flexible tube with the supply tube through the use of a clamping band or the like;
- supplying a flow of filling material, if desired, in combination with water, through the supply tube;
- decoupling the supply tube and the flexible tube; and
- if desired, guiding the flexible tube into the container. A pump may be used to supply the flow of filling material.

DETAILED DESCRIPTION OF THE PREFERRED EMBODIMENTS

Figure 1:
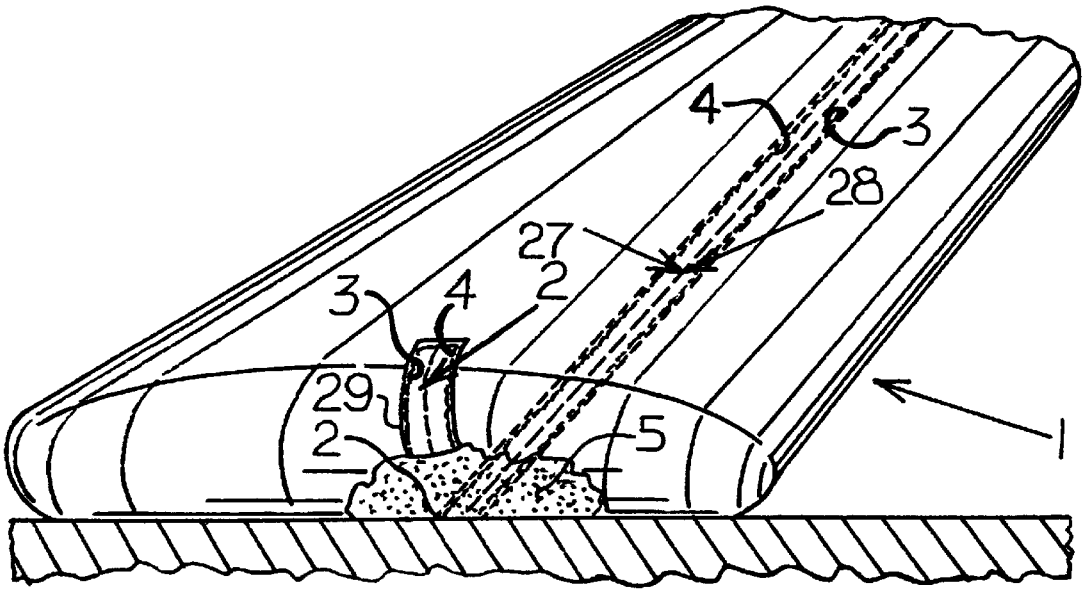
FIG. 1 is a perspective view of an elongate container of the present invention.
Figure 1A:
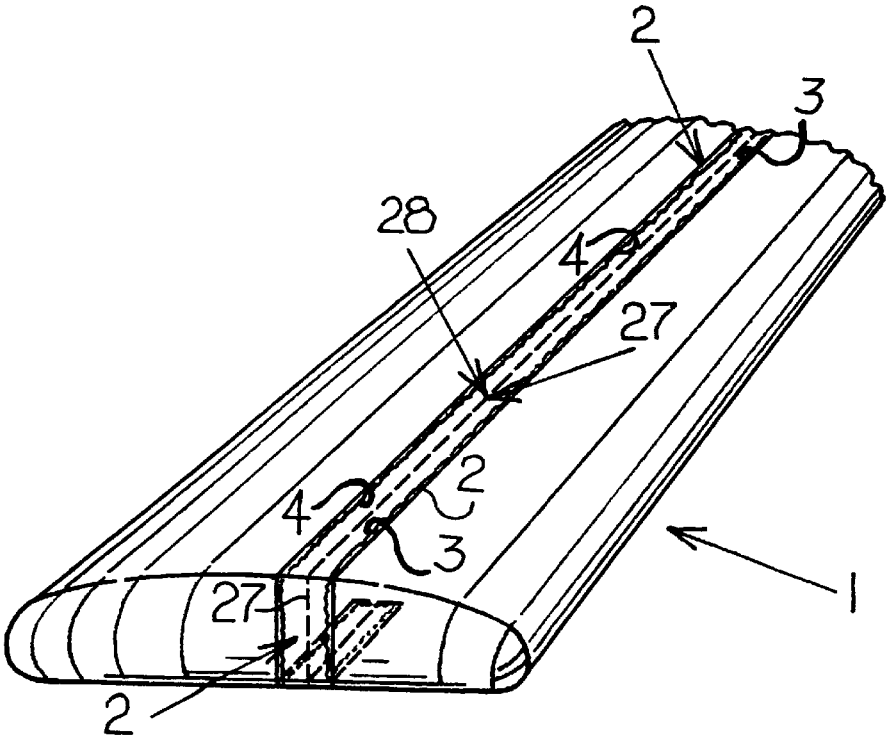
FIG. 1A is a perspective view of a lower side of the elongate container according to an embodiment of the present invention.

FIG. 1 shows an elongate flexible container 1 that is predominantly made of a textile fabric and has facing longitudinal edges 27, 28. The container 1 is formed by mutually connecting the facing longitudinal edges 27, 28 of the textile fabric by means of a stitching zone or swatch 2, thereby forming the tubular structure shown in FIG. 1. The stitching zone or swatch 2 is preferably a separate piece of material 29 connected to the textile fabric by stitching 3, 4 at the lower side of container 1, as shown in further detail in FIG. 1A.

The container 1 shown in FIG. 1 is filled with solid material 5. It is noted that FIGS. 1 and 1A do not show at the upper side of the container 1 that one or more filling openings are provided. This aspect will be discussed with reference to FIG. 3. FIG. 1 shows an important aspect of the invention. Since the stitching zone or swatch 2 is arranged at the lower side of the container the stitching zone or swatch 2 is fully embedded or positioned between the solid filling material 5 and the ground 6 or other surface present at the lower side, with the weight of the solid filling material pressing on the stitching zone or swatch 2. In this way, the stitching zone or swatch 2 is effectively decoupled from tensile forces in a transverse direction relative to the longitudinal direction of the container 1. This ensures a very long lifetime of the container 1, while the stitching zone or swatch 2 and stitching 3, 4 can be formed relatively weakly.

Figure 2:
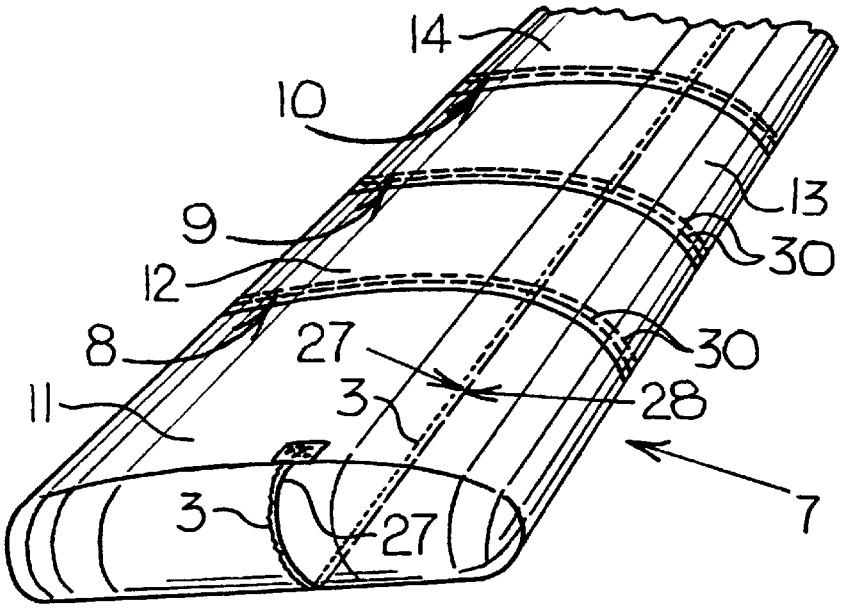
FIG. 2 is a perspective view of an alternative embodiment of the elongate container of the present invention.

FIG. 2 shows an embodiment in which a container 7 is provided with stitching 3 arranged at its lower side and extending in a longitudinal direction of the container 7. The container 7 includes a plurality of parts 11, 12, 13, 14 that is mutually abutting and mutually connected by respective stitching seams 8, 9, 10. The stitching seams 8, 9, 10 each include stitching which is identified with reference numeral 30 in FIG. 2 and extends transversely relative to the longitudinal direction of the container 7. In this embodiment, the stitching seams 8, 9, 10 are formed by overlapping the fabric material of the parts 11, 12, 13, 14 and securing the parts 11, 12, 13, 14 with the stitching 30 of the stitching seams 8, 9, 10.

Figure 3:
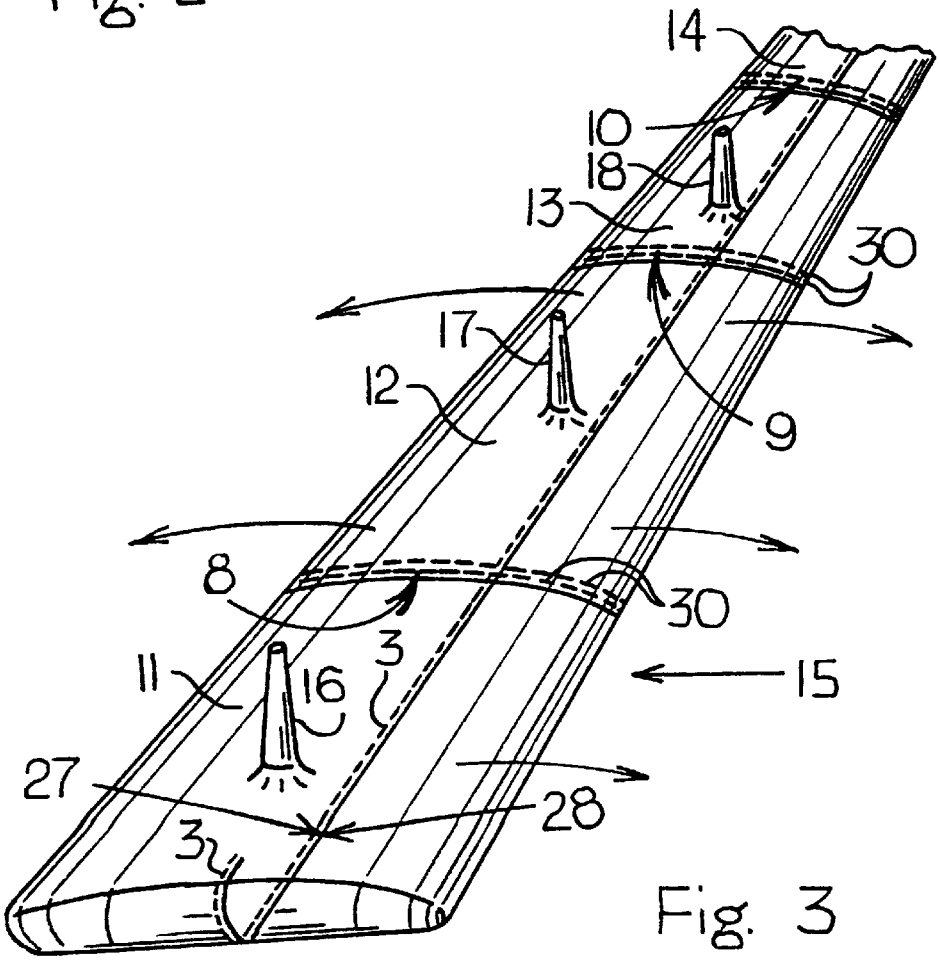
FIG. 3 is a perspective view of another embodiment of the elongate container of the present invention.

FIG. 3 shows an embodiment in which a container 15, similar to container 7 according to FIG. 2, includes stitching 3 arranged at its lower side. The container 15 is similar to the container 7 of FIG. 2 in that the container 15 includes a plurality of parts 11, 12, 13, 14 mutually connected by respective stitching seams 8, 9, 10. The stitching seams 8, 9, 10 each include stitching 30 extending transversely relative to the long direction of the container 7. At the upper side of the container 15, a plurality of flexible filling tubes 16, 17, 18 distributed over the entire length of the container 15 is provided. The filling tubes 16, 17, 18 are located at regular mutual distances of, e.g., about 25 meters. It is noted that during a filling operation, solid filling material is passed through one of the filling tubes 16, 17, 18. The non-used filling tubes 16, 17, 18 are not necessarily inoperative, but may serve as overpressure and/or over-flow valves. After filling, the flexible filling tubes 16, 17, 18 may be pushed into the filled container 15, and a natural closing of the container 15 is thus achieved.

Figure 4:
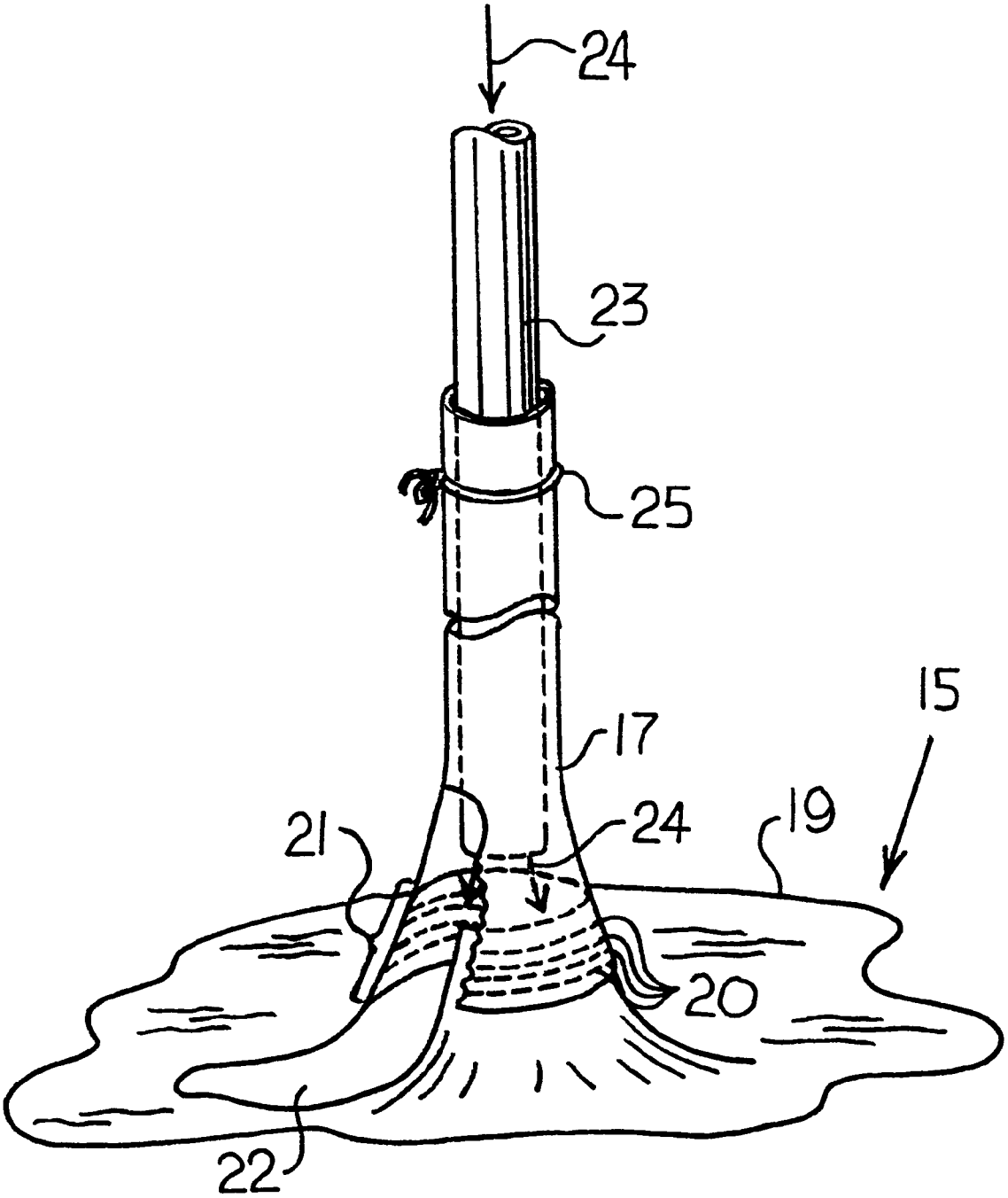
FIG. 4 is a perspective view of a part of the container according to FIG. 3.

FIG. 4 shows an embodiment in which a filling tube is connected with textile fabric 19 of the container 15. In this embodiment, a tapering filling tube 17, which widens in a downward direction toward the container 15, is connected with the periphery of an opening 22 in the textile fabric 19 by a stitching zone or area 21 which, in this case, includes stitching 20 defining four stitching seams. A stiff filling tube 23 fits in the smallest outer part of the filling tube 17 and serves as a conduit for passing solid filling material into the container 15 according to arrows 24. A pumping means (not shown) may be used to fill the container 15. Since a relative longitudinal movement force occurs between flexible filling tubes 17 and stiff filling tube 23, a clamping band 25 is provided for mutually coupling these tubes. After filling the container 15, the band 25 is made inoperative, the tube 23 is removed, and the filling tube 17 may be inserted in the filled container 15 through opening 22, as discussed previously.

It is noted that the elongate flexible container according to the present invention is generally suited to be positioned and filled on dry land or at a relatively small depth on the bottom of a waterway having a depth of less than 3 meters. The container according to the previously mentioned co-pending patent application entitled "flexible container" is generally used for larger depths, for example on the order of more than 4–6 meters.

It is furthermore noted that FIGS. 1, 1A, 2 and 3 show an idealized shape of the filled container. In general the container will exhibit a certain irregularity, because it conforms to the shape of the surface the container is resting upon. Furthermore, the container according to the invention is suited to be arranged in bended shapes.

What is claimed is:

1. An elongate flexible container formed from a textile fabric, the elongate flexible container comprising:

an upper side having at least one filling opening;

a lower side having stitching extending in a longitudinal direction of the container, with the stitching connecting facing longitudinal edges of the textile fabric; and a plurality of parts abutting in the longitudinal direction and mutually connected by stitching seams, with the stitching seams having stitching extending transverse to the longitudinal direction and mutually connecting the plurality of parts.

2. The container according to claim 1 wherein:

the stitching at the lower side of the container extending in the longitudinal direction connects two tangentially overlapping edges of fabric.

3. The container according to claim 1, further comprising a plurality of filling openings arranged in distributed manner over an entire length of the container.

4. The container according to claim 3, wherein each of the filling openings includes a flexible tube.

5. The container according to claim 4, wherein each of the flexible tubes has a length between 0.5 and 3 meters and a diameter between 0.2 and 0.7 meters.

6. The container according to claim 1, wherein the textile fabric is water-permeable.

7. The container according to claim 1, wherein the fabric has in the transverse and the longitudinal directions a tensile strength of over 80 kN/m.

8. The container according to claim 1, wherein the fabric is made of polypropylene.

9. The container according to claim 1, wherein the fabric is made of a polyester and a polyethylene.

10. The container according to claim 4, wherein each of the flexible tubes widens in a downward direction toward the flexible container.

* * * * *

UNITED STATES PATENT AND TRADEMARK OFFICE

CERTIFICATE OF CORRECTION

PATENT NO. : 6,186,701 B1
DATED : February 13, 2001
INVENTOR(S) : Anton Daniel Kempers It is certified that error appears in the above-identified patent and that said Letters Patent is hereby corrected as shown below:

Column 3,
Line 42, "long" should read -- longitudinal --.

Signed and Sealed this

Eleventh Day of September, 2001

Nicholas P. Godici

*Attest:*

*Attesting Officer*

NICHOLAS P. GODICI
*Acting Director of the United States Patent and Trademark Office*